US007201149B2

(12) United States Patent
Magel

(10) Patent No.: US 7,201,149 B2
(45) Date of Patent: Apr. 10, 2007

(54) FUEL INJECTOR WITH MULTISTAGE CONTROL VALVE FOR INTERNAL COMBUSTION ENGINES

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 11/123,068

(22) Filed: May 6, 2005

(65) Prior Publication Data

US 2005/0263133 A1 Dec. 1, 2005

(30) Foreign Application Priority Data

May 6, 2004 (DE) ..... 10 2004 022 270

(51) Int. Cl.
*F02M 59/46* (2006.01)
*F02M 59/00* (2006.01)

(52) U.S. Cl. ..... 123/467; 123/446

(58) Field of Classification Search ..... 123/446, 123/467, 468, 469, 472, 447, 456; 239/88–96, 239/533.1, 533.3, 533.12
See application file for complete search history.

(56) References Cited

U.S. PATENT DOCUMENTS 6,453,875 B1 * 9/2002 Mahr et al. ..... 123/446
6,889,659 B2 * 5/2005 Magel ..... 123/446
6,915,785 B2 * 7/2005 Eisenmenger et al. ..... 123/446

* cited by examiner

*Primary Examiner*—Mahmoud Gimie
(74) *Attorney, Agent, or Firm*—Ronald E. Greigg

(57) ABSTRACT

A fuel injector for injecting fuel into the combustion chamber of an internal combustion engine is equipped with a pressure booster that has a working chamber continuously connected to a common rail, and has a differential pressure chamber, which a piston part separates from the working chamber. The fuel injector also has an injection valve member. To actuate the fuel injector, a valve having a control valve in the form of a servo valve and an actuating valve that actuates this control valve. The multistage valve controls both the pressure booster and the injection valve member. The control valve and the actuating valve are hydraulically coupled to each other and different outlet throttles can be opened and closed in order to achieve different opening speeds of a servo valve piston.

11 Claims, 3 Drawing Sheets

FUEL INJECTOR WITH MULTISTAGE CONTROL VALVE FOR INTERNAL COMBUSTION ENGINES

BACKGROUND OF THE INVENTION

1. Field of the Invention

It is possible to use both pressure-controlled and stroke-controlled injection systems to supply fuel to combustion chambers of autoignition internal combustion engines. In addition to unit fuel injectors, these fuel injection systems are also embodied in the form of unit pumps and accumulator (common rail) injection systems. Common rail injection systems advantageously permit the injection pressure to be adapted to the load and speed of the engine. It is generally necessary to achieve the highest possible injection pressure in order to achieve high specific loads and reduce engine emissions of internal combustion engines.

2. Description of the Prior Art

DE 101 23 910.6 relates to a fuel injection system that is used in an internal combustion engine. Fuel injectors supply fuel to the respective combustion chambers of the engine. A high-pressure source acts on the fuel injectors; the fuel injection system designed according to DE 101 23 910.6 also includes a pressure booster with a moving pressure boosting piston that separates a chamber, which can be connected to the high-pressure source, from a high-pressure chamber connected to the fuel injector. The fuel pressure in the high-pressure chamber can be varied by filling a differential pressure chamber of the pressure booster with fuel or by emptying fuel from this pressure chamber.

The fuel injector has a moving closing piston for opening and closing injection openings oriented toward the combustion chamber. The closing piston protrudes into a closing pressure chamber so that fuel pressure can be exerted on it. This generates a force that acts on the closing piston in the closing direction. The closing pressure chamber and an additional chamber are comprised by a shared working chamber; all of the sub-regions of the working chamber are connected to one another continuously to permit the exchange of fuel.

With this design, triggering the pressure booster by means of the differential pressure chamber makes it possible to keep the triggering losses in the high-pressure fuel system low in comparison to a triggering by means of a working chamber that is connected to the high-pressure fuel source intermittently. In addition, the high-pressure chamber is only depressurized down to the pressure level of the common rail and not down to the leakage pressure level. On the one hand, this improves the hydraulic efficiency and on the other hand, it permits a more rapid pressure reduction down to the system pressure level so that intervals of time between the injection phases can be significantly shortened. In pressure-controlled injection systems equipped with a pressure booster, the problem arises that the stability of the injection quantities to be injected into the combustion chamber cannot be guaranteed, particularly the achievement of very low injection quantities such as those required in preinjections. This is primarily due to the fact that an injection valve member opens very quickly in pressure-controlled injection systems. As a result, very small variations in the triggering duration of the control valve have a powerful impact on the injection quantity. Attempts have been made to remedy this problem by using a separate needle stroke damper piston that delimits a damping chamber and must be guided in a high-pressure-tight clearance fit. This design does in fact permit a reduction in the needle opening speed, but it significantly increases the structural complexity and therefore the costs incurred to produce the injection system.

DE 102 29 418 has disclosed a device for damping the needle stroke in the fuel injector. In this design, the fuel injection system has a common rail, a pressure booster, and a metering valve. The pressure booster has a working chamber and a control chamber, which are separated from each other by an axially moving piston. A pressure change in the control chamber of the pressure booster causes a pressure change in a compression chamber that acts on a nozzle chamber via a fuel inlet. The nozzle chamber encompasses an injection valve member, which can be embodied, for example, in the form of a nozzle needle. A nozzle spring chamber that acts on the injection valve member can be filled on the high-pressure side from the compression chamber of the pressure booster via a line that contains an inlet throttle restriction. On the outlet side, the nozzle spring chamber is connected to a chamber of the pressure booster via a line that contains an outlet throttle restriction.

DE 102 29 415 likewise relates to a device for needle stroke damping in pressure-controlled fuel injectors. According to this design, a fuel injection apparatus includes a fuel injector, which can be acted on with highly pressurized fuel by a high-pressure source and can be actuated by means of a metering valve. The injection valve member is associated with a damping element, which can move independently of it and delimits a damping chamber. The damping element has at least one overflow conduit for connecting the damping chamber to an additional hydraulic chamber.

In the designs known from DE 102 29 418 and DE 102 29 415, the control valve is embodied in the form of a 3/2-way valve and controls a relatively large return quantity of the pressure booster. In particular, servo valves are used for this purpose. The above-mentioned triggering variants for fuel injectors equipped with only one valve have the disadvantage of a lack of flexibility with regard to the shaping of the injection pressure curve (rate shaping) in comparison to fuel injectors equipped with two actuators that are independent of each other.

OBJECT AND SUMMARY OF THE INVENTION

In order to increase the flexibility with regard to the shaping of the injection pressure curve (rate shaping) of fuel injectors, the present invention proposes a servo control valve that permits the injection pressure curve in the fuel injector to be shaped through the use of different control valve opening speeds. It is possible to achieve different opening speeds of the valve member, e.g. of a servo piston belonging to a servo control valve, by means of a multistage control valve within the servo circuit, e.g. by means of a 3/3-way solenoid valve. It is therefore possible for the motor control unit of the internal combustion engine to determine the quantity of fuel to be injected into the combustion chamber of the internal combustion engine, i.e. the injection rate. The flexibility, i.e. the shaping of the injection pressure curve (rate shaping), can therefore be increased, and the injection quantity can thus be optimally adapted to the respective requirements of an internal combustion engine.

To that end, the present invention proposes using a three-stage 3/3-way control valve to control the servo circuit of a servo control valve that actuates a fuel injector. Depending on the switched position of the three-stage 3/3-way control valve, different outlet throttle cross sections can be opened through which different diversion volumes can be discharged, which makes it possible to achieve different opening speeds of the valve member embodied in the form of a servo valve piston.

If the control edges in the 3/2-way valve member are suitably designed, then these different opening speeds can be used to shape the injection pressure. The design proposed according to the present invention also makes it possible to use only a single actuator, e.g. a piezoelectric actuator or solenoid valve, for each fuel injector so as to limit production engineering costs. The cost related to a modification of the control unit of the internal combustion engine likewise remains low since only one output stage is provided for each fuel injector, i.e. the number of output stages is limited to the number of cylinders in the internal combustion engine to be fed.

The multistage control valves here can be solenoid valves or piezo valves as well as valves that permit a continuous cross-sectional control.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
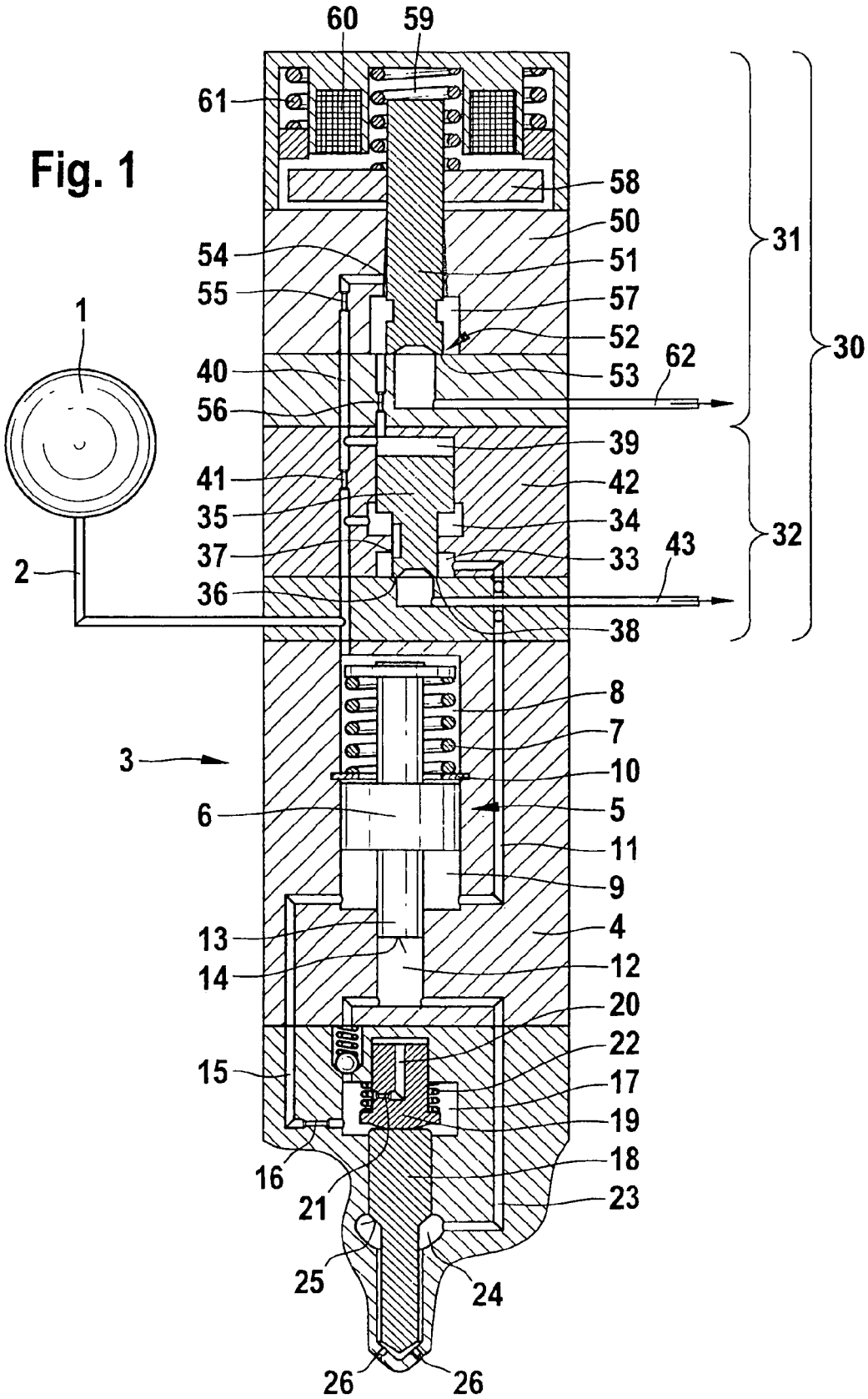
FIG. 1 schematically depicts an embodiment of a fuel injector equipped with a servo valve whose servo circuit is controlled by a 3/3-way solenoid valve.

FIG. 1 shows a first embodiment variant of a fuel injector equipped with a pressure booster and a valve for triggering, which is embodied in a multistage design.

FIG. 1 shows that a fuel injector 3 equipped with a pressure booster 5 is connected to a common rail 1 via a high-pressure line 2. The fuel injector 3 has an injector housing 4 that is preferably comprised of multiple parts, which contains the pressure booster 5. The pressure booster 5 has a first piston part 6, which is acted on by means of a return spring 7. The return spring 7 rests against a for example annular stop 10 contained in a working chamber 8 of the pressure booster 5. The working chamber 8 of the pressure booster 5 continuously communicates with the common rail 1 and is acted on by the system pressure level prevailing in the common rail 1. The first piston part 6 separates the working chamber 8 and a differential pressure chamber 9 of the pressure booster 5 from each other. The differential pressure chamber 9 can be depressurized via a control line 11.

The pressure booster 5 also has a compression chamber 12 that is acted on by an end surface 14 of a second piston part 13 of the pressure booster 5. In accordance with the pressure boosting ratio, which depends on the design of the pressure booster 5, the fuel volume contained in the compression chamber 12 is compressed to a higher pressure. A nozzle chamber inlet 23 branches off from the compression chamber 12 of the pressure booster 5 and acts on a nozzle chamber 24 of the fuel injector 3 with a higher pressure level, which can be achieved depending on the boosting ratio of the pressure booster 5.

An overflow line 15 that contains a first throttle restriction 16 extends from the differential pressure chamber 9 of the pressure booster 5 and feeds into a pressure chamber 17. The pressure chamber 17 contains a damping piston 19 whose one end acts on an opposing end of an injection valve member 18 in the form of a nozzle needle that can be embodied, for example, in one piece. The damping piston 19 has a bore 20 that contains a second throttle restriction 21. In addition, the damping piston 19 is acted on by a spring 22 that rests against a wall of the pressure chamber 17.

The nozzle chamber inlet 23 extending from the compression chamber 12 of the pressure booster 5 to the nozzle chamber 24 acts on the nozzle chamber 24 with a highly pressurized fuel volume. The injection valve member 18, which can be embodied in one piece, for example, is provided with a pressure shoulder 25 inside the nozzle chamber 24 that encompasses the injection valve member 18. Fuel at the increased pressure level flowing into the nozzle chamber 24 exerts a hydraulic force in the opening direction on the pressure shoulder 25 of the injection valve member 18, which can be embodied in one piece, for example. Fuel contained in the nozzle chamber 24 flows through an annular gap to injection openings 26, which in the open position of the injection valve member 18, permit the injection of a fuel quantity into a combustion chamber of an internal combustion engine, not shown here. In order to depressurize the differential pressure chamber 9 of the pressure booster 5, the control line 11 feeds into a control valve 32 of a multistage valve 30, which is situated in the upper region of the fuel injector 3. The control line 11 feeds into a first hydraulic chamber 33 of the control valve 32. The servo valve piston 35 of the control valve 32 is provided with a flat seat 38 for closing the first hydraulic chamber 33 of the control valve 32. The flat seat 38 in the lower region of the servo valve piston 35 closes a first control edge 36. A second control edge 37 is also provided in the housing 42 of the control valve 32. Above the first hydraulic chamber 33, the housing 42 of the control valve 32 contains a second hydraulic chamber 34, which is connected to a branch 40 of the high-pressure line 2. As a result, the system pressure level prevailing in the common rail 1 is always present in the second hydraulic chamber 34. The upper region of the housing 42 contains a pressure chamber 39. Upstream of this pressure chamber 39, a third throttle restriction 41 is provided, which leads away from the branch 40 of the high-pressure line 2. Below the first control edge 36, the housing 42 of the control valve 32 also contains a low-pressure chamber that the servo valve piston 35 opens or closes depending on its position. A first return 43 leads from this chamber into the low-pressure region of a fuel injection system not shown in detail here.

The pressure chamber 39 of the control valve 32 has a line extending from it, which contains a fifth throttle restriction 56. This line extends parallel to the branch 40 of the high-pressure line 2 feeding into the housing 50 of the actuating valve 31 at a fourth control edge 54. The housing 50 of the actuating valve 31 contains a vertically moving valve member 51. At its lower end, it is provided with an additional flat seat 52 that opens and closes a third control edge 53. Underneath the flat seat 52, a low-pressure side hydraulic chamber is provided, from which a return 62 leads to a low-pressure region of a fuel injection system, not shown in detail here. The branch 40 of the high-pressure line 2 that extends inside the housing 50 of the control valve 31 contains a fourth throttle restriction 55. The housing 50 of the control valve 31 also contains a hydraulic chamber 57, which is separated from the second return 62 by the cooperating action of the additional flat seat 52 and the first control edge 53.

Above the housing 50 of the control valve 31, an armature 58 is provided, which cooperates with a magnetic coil 60. Instead of the magnet armature/magnetic coil apparatus 58, 60, the actuating valve 31 can also be actuated by means of a piezoelectric actuator not shown in FIG. 1.

In the depiction in FIG. 1, a closing spring 59 acts on the armature 58 of the actuating valve 31. An additional spring element 61 extends parallel to the closing spring 59; this additional spring element 61 prestresses a stop for the armature 58 of the actuating valve 31 and, when the magnetic coil 60 is supplied with current, serves as a stroke limitation and damping device to damp chattering of the armature 58.

Figure 2:
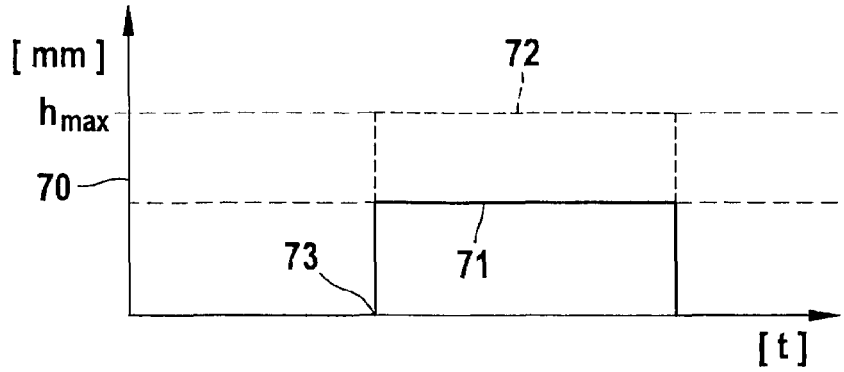
FIG. 2 shows triggering variants of the 3/3-way solenoid valve with different triggering currents.

FIG. 2 shows different current supply levels of the actuating valve 31, with the stroke path 70 of the valve member 51 of the actuating valve 31 being plotted over the time axis with levels of different current. At a first current supply level 71, a first stroke path of the valve member 51 occurs, beginning at a triggering time 73 at which the magnetic coil 60 or a piezoelectric actuator of the actuating valve 31 is supplied with current. The depiction also shows the stroke path traveled by the valve member 51 of the actuating valve 31 when it is supplied with a second current supply level 72. In the latter case, the valve member 51 of the actuating valve 31 travels a maximum stroke path.

If the magnetic coil 60 is supplied with a first, relatively low current level 71, then the valve member 51 of the actuating valve 31 moves into a first, middle switched position. In this state, the magnet armature 58 rests against a for example annular stop that encompasses the magnetic coil 60 and is prestressed by the additional spring 61. In this switched position, the fifth throttle restriction 56 is open while the fourth throttle restriction 55 remains closed. The additional flat seat 52 remains open so that the fuel volume contained in the hydraulic chamber 57 can flow out into the second return and into the low-pressure region of the fuel injection system. As a result, the control valve 32 depressurizes the pressure chamber 39. The servo valve piston 35 travels upward and in turn opens the flat seat 38. This allows the fuel stored in the differential pressure chamber 9 of the pressure booster 5 to flow out via the second hydraulic chamber 33 into the first return 43 and to the low-pressure side of the fuel injection system.

The servo valve piston 35 opens slowly so that a delayed, slow pressure buildup occurs in the compression chamber 12, which, via the nozzle chamber inlet 23 and the nozzle chamber 24, results in a slow opening of the injection valve member 18, which can be embodied in one piece, for example. As a result, the injection openings 26 into the combustion chamber of an autoignition internal combustion engine are only opened slowly so that a first pressure increase, which is labeled with the reference numeral 91 in FIG. 4, occurs during the injection through the nozzle.

Figure 3:
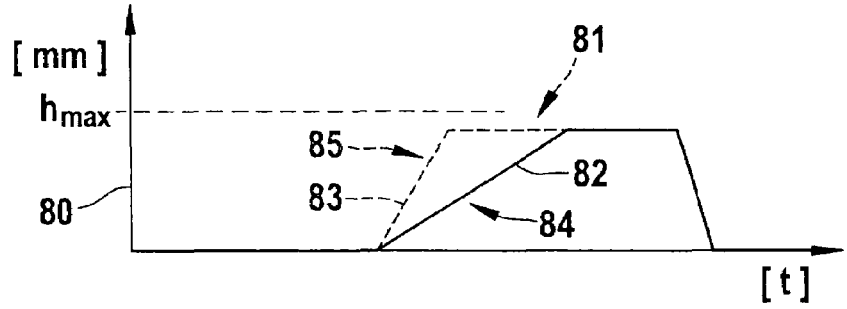
FIG. 3 shows the strokes of the valve member that occur at the triggering current levels from FIG. 2.

FIG. 3 shows the stroke of the servo valve piston 35 of the valve 32 occurring at the first current supply level 71 and the stroke of the servo valve 35 occurring at the second current supply level 72.

Figure 4:
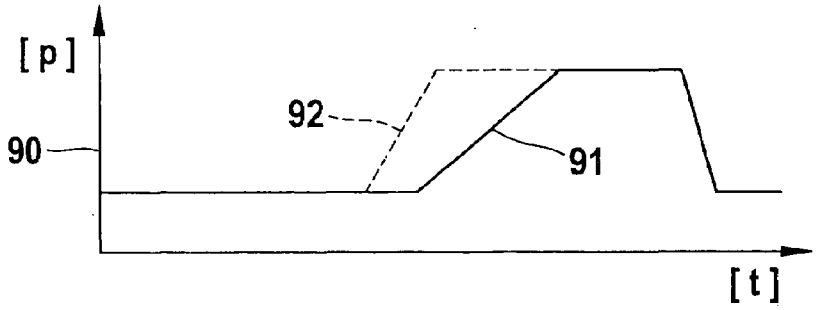
FIG. 4 shows nozzle pressures that occur in accordance with the stroke curves.
Figure 5:
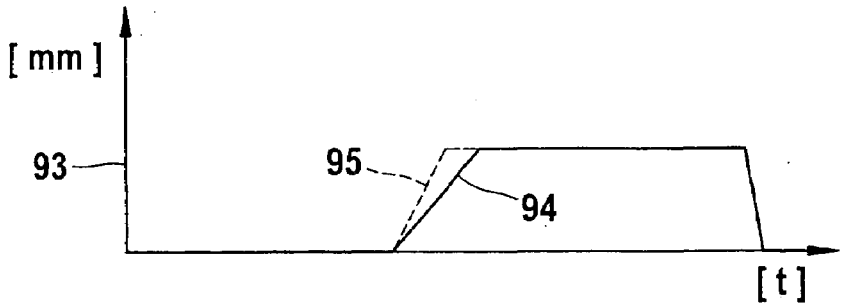
FIG. 5 shows the injection valve member stroke movements that occur.

If, as shown in FIG. 2, the magnetic coil 60 of the actuating valve 31 is supplied with a second, higher current level 72, then this yields the stroke curve 95 of the valve member 51 of the actuating valve 31 (see FIG. 5). In this case, the valve member 51 moves into another, second switched position in which the armature 58 that is connected to the valve member 51 travels further vertically upward, counter to the action of the closing spring 59 so that both the fourth throttle restriction 55 and the fifth throttle restriction 56 are opened. The opening of the fifth throttle restriction 56 occurs due to the opening of the additional flat seat 52 at the third control edge 53, whereas the opening of the fourth throttle restriction 55 is achieved due to a vertical lifting of the annular groove-equipped valve member 51 of the actuating valve 31. As a result, a control volume flows through the two open throttle restrictions 55, 56 that function as outlet throttles, into the second return 62 to the low-pressure side of the fuel injection system. As a result, a quicker pressure decrease in the pressure chamber 39 occurs, which contributes to a quicker opening of the servo valve piston 35 into the pressure chamber 39 at a high opening speed. Consequently, a quicker depressurization of the differential pressure chamber 9 of the pressure booster 5 occurs, accompanied by a quicker pressure increase in the compression chamber 12 and therefore—via the nozzle chamber inlet 23—in the nozzle chamber 24 encompassing the injection valve member 18. The injection valve member 18 travels upward faster so that higher pressure is generated at the injection openings 26, resulting in the pressure increase in the injection nozzle, as identified by the reference numeral 92 in FIG. 4.

Whereas FIG. 2 shows the triggering current levels of the valve member 51 of the actuating valve 31 in relation to each other, both of which occur starting at the triggering time 73, FIG. 3 shows stroke paths 80 of the servo valve piston 35 of the control valve 32 in relation to each other. If the magnetic coil 60 and magnetic actuator are supplied with a first, lower current level 71, then the servo valve piston 35 executes a ramp-shaped stroke labeled with the reference numeral 82, which is characterized by a first slope 84.

If the magnetic coil 60 or a piezoelectric actuator of the actuating valve 31 is supplied with a second current supply level 72, though, then this yields a second ramp-shaped stroke 83 as shown in FIG. 3, which has a second slope 85. Both strokes 82, 83 are limited by the maximum stroke path $H_{max}$, which is indicated in FIG. 3 by a plateau 81 that extends just under the maximum stroke path $H_{max}$ of the servo valve piston 35.

FIG. 4 shows the pressure curve of the injection nozzle. If the magnetic coil 60 or the piezoelectric actuator of the actuating valve 31 is supplied with a first, lower current level 71, then a first pressure increase 91 according to FIG. 4 occurs in the injection nozzle, whereas if the magnetic coil 60 or a piezoelectric actuator of the actuating valve 31 is supplied with a higher current level (see reference numeral 72 in FIG. 2), then a second pressure increase 92 occurs at the combustion chamber end of the injection nozzle.

FIG. 5 shows the stroke curves 93 of the injection valve member 18. The reference numeral 94 indicates the stroke of the injection valve member 18 when the magnetic coil 60 or the piezoelectric actuator is supplied with a first, lower current level 71 and has a more gradual increase in comparison to when the magnetic coil 60 or the piezoelectric actuator of the actuating valve 31 is supplied with a second, higher current level 72. In FIG. 5, the reference numeral 95 indicates the stroke curve of the injection valve member 18 when the magnetic coil 60 or a piezoelectric actuator of the actuating valve 31 is supplied with the second current supply level 72.

In the deactivated idle state, the multistage valve 30 is closed. The flat seat 38 of the control valve 32 is thus likewise closed, which shuts off the connection between the differential pressure chamber 9 of the pressure booster 5 and a control line 11 from the first return 43 into the low-pressure region of the fuel injector. In this state, the pressure booster 5 is pressure-balanced so it does not generate any boosting of pressure.

To activate the pressure booster 5, the multistage valve 30 depressurizes the differential pressure chamber 9. This occurs through the supply of a current to the magnetic coil 60, whereupon the valve member 51 travels upward and opens the additional flat seat 52. The open additional flat seat 52 permits a control volume coming through the branch 40 and the fourth throttle restriction 55 to flow into the second low-pressure side return 62. Because of the depressurization of the pressure chamber 39, the servo valve piston 35 travels upward and opens the flat seat 38 so that fuel flows out of the differential pressure chamber 9 via the control line 11, into the first return 43 to the low-pressure side of the fuel injection system. As a result, the pressure in the compression chamber 12 increases sharply and is conveyed in accordance with the boosting ratio of the pressure booster 5 into the nozzle chamber 24 via the nozzle chamber inlet 23. A hydraulic force acting in the opening direction builds up against the pressure shoulder 25 of the injection valve member 18 so that the injection openings 26 in the combustion chamber end of the fuel injector 3 are opened and fuel can be injected through them.

To terminate the injection process, the actuating valve 31 is deactivated, i.e. the supply of current to the magnetic coil 60 or a piezoelectric actuator is suspended. The closing spring 59 moves the valve member 51 into its closed position, thus closing the additional flat seat 52. This assures a pressure buildup in the pressure chamber 39 of the control valve 32 so that the flat seat 38 of the servo valve piston 35 moves into its closed position. In this state, the first control edge 36 above the low-pressure side hydraulic chamber from which the first return 43 into the low-pressure region of the fuel injection system is fed, is closed and the piston parts 6, 13 of the pressure booster 5 move back into their idle position. As a result, the pressure in the pressure chamber 24 drops, as does the hydraulic force acting in the opening direction generated therein so that the depressurization of the pressure chamber 17 causes the injection valve member 18 to travel into its closed position assisted by the spring 22.

The compression chamber 12 of the pressure booster 5 is refilled by means of a check valve that is connected between the pressure chamber 17 above the injection valve member 18 and the compression chamber 12 of the pressure booster 5.

The injection shapes that can be achieved by means of the different current supply levels 71, 72 of the magnetic coil 60 or a piezoelectric actuator of the actuating valve 31 can be varied within characteristic fields by means of a control unit associated with the internal combustion engine. The opening speeds of the multistage valve 30 can thus be adapted to the respective operating conditions of the autoignition internal combustion engine. If a slow movement of the servo valve piston 35 of the control valve 32 and a slow movement of the valve member 51 of the actuating valve 31 are assured, then it is in particular possible to reproducibly achieve the small injection quantities required for preinjections of fuel into the combustion chamber of an internal combustion engine.

Figure 6:
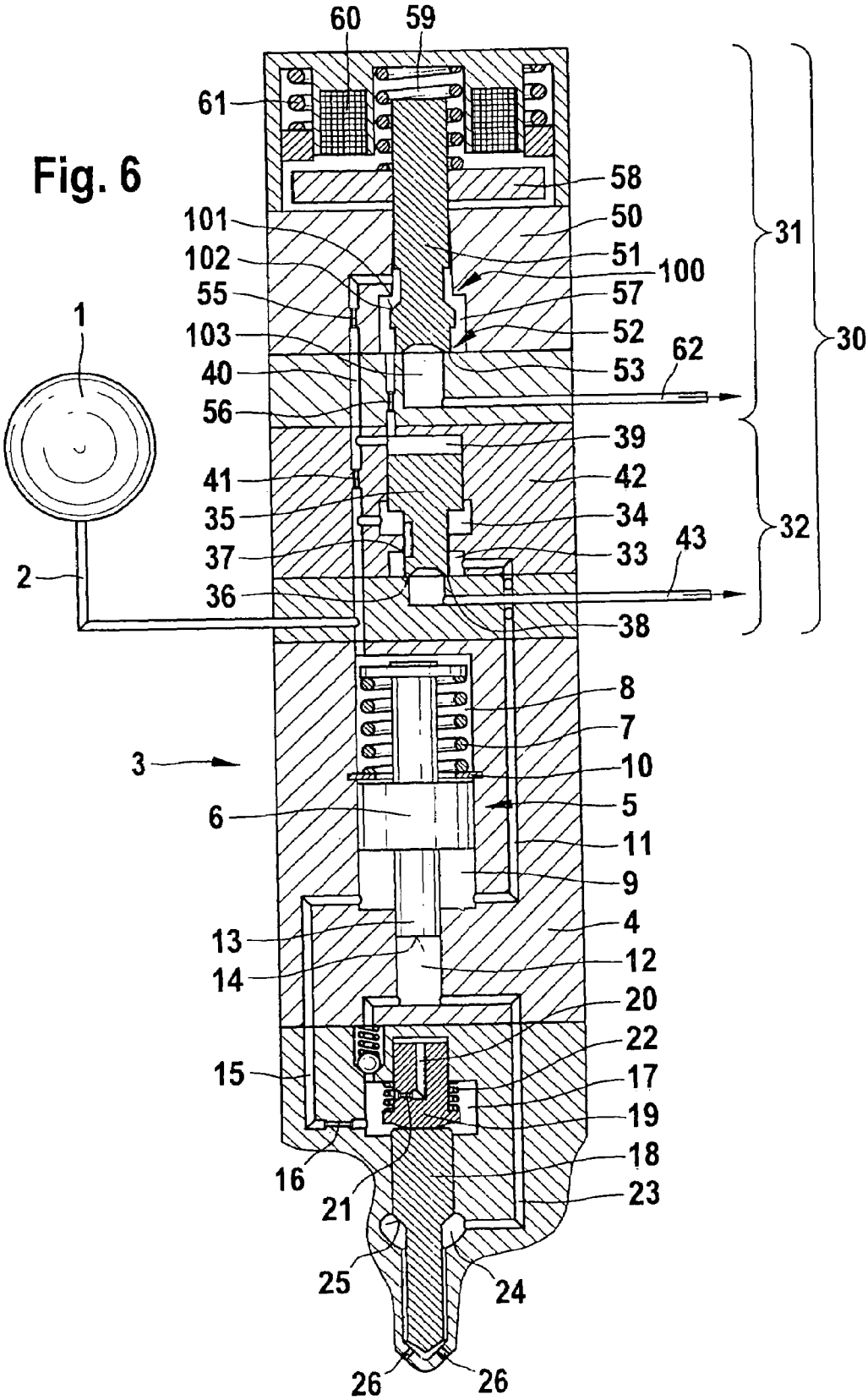
FIG. 6 shows another embodiment variant of the fuel injector shown in FIG. 1 in which the solenoid valve is equipped with a seat/seat valve instead of a slide valve.

FIG. 6 shows another embodiment variant of the fuel injector shown in FIG. 1. The operation of the fuel injector 3 shown in FIG. 6 corresponds essentially to that of the fuel injector 3 shown in FIG. 1, to which reference is made here to avoid repetition.

By contrast with FIG. 1, modifications have been made to the multistage valve 30 shown in this figure, in particular, to the actuating valve 31. Whereas in the embodiment variant according to FIG. 1, the valve member 51 has a sliding seal that closes the fourth control edge 54, in FIG. 6, the valve member 51 is provided with a valve seat 100. The valve seat 100, which can be provided on the housing 50 of the actuating valve 31, cooperates with a conical surface 102 of the valve member 51. The conical surface 102 of the valve member 51 cooperates with a seat edge 101. The embodiment variant of the actuating valve 31 with a valve seat 100 advantageously permits the achievement of a powerful sealing action that cannot always be achieved by a sliding seal as shown in FIG. 1 when small strokes are executed. The reference numeral 103 indicates a low-pressure chamber from which the return line 62 extends into the low-pressure region of the fuel supply system.

The switching functions are consequently reversed in the embodiment variant shown in FIG. 6. In the middle switched position of valve member 51, the throttle restrictions 55 and 56 functioning as outlet throttles are opened so that the servo valve piston 35 opens quickly, which results in a rapid pressure buildup at the beginning of the injection. By contrast, in the upper switched position, i.e. when the magnetic coil 60 or a piezoelectric actuator of the actuating valve 31 is supplied with a higher current level, the fifth throttle restriction 56 is opened, whereas the fourth throttle restriction 55 is closed. In this case, the servo valve piston 35 of the control valve 32 opens more slowly so that a delayed pressure buildup occurs at the beginning of the injection. With regard the achievable opening speeds for influencing the opening speed of the multistage valve 30, the embodiment variant shown in FIG. 6 behaves in a manner precisely opposite the one described in the explanations made in connection with FIG. 1.

The foregoing relates to preferred exemplary embodiments of the invention, it being understood that other variants and embodiments thereof are possible within the spirit and scope of the invention, the latter being defined by the appended claims.

I claim:

1. A fuel injector (3) for injecting fuel into the combustion chambers of an internal combustion engine, the fuel injector comprising an injection valve member (18) and a pressure booster (5) that has a working chamber (8), which is continuously connected to a common rail (1) and is separated from a differential pressure chamber (9) by a piston part (6, 13), it being possible to either depressurize or pressurize the differential pressure chamber (9) of the pressure booster (5) by means of a valve (30), and a valve (30) operable to depressurize or pressurize the differential pressure chamber (9) of the pressure booster (5) and to control the injection valve member (18), the valve (30) having a control valve (32), which is equipped with a servo valve piston (35), and an actuator-triggered multistage actuating valve (31), wherein, in an intermediate position of a valve member (51) of the actuating valve (31), when an actuator (60) is supplied with a first current level (71), a throttle restriction (56) functioning as an outlet throttle is opened in order to depressurize the pressure chamber (39) of the control valve (32), and an additional throttle restriction (55), which is parallel to the throttle restriction (56), remains closed.

2. The fuel injection device according to claim 1, wherein the control valve (32) has a pressure chamber (39) that acts on the servo valve piston (35) and is flow connected to a hydraulic chamber (57) of the actuating valve (31).

3. The fuel injection device according to claim 1, wherein the control valve (32) and the actuating valve (31) are flow connected to each other via a branch (40) extending from a high-pressure line (2).

4. The fuel injection device according to claim 1, wherein when the actuator (60) of the actuating valve (31) is supplied with a second current level (72), which is higher than the first current level (71), to depressurize the pressure chamber (39) of the control valve (32), the throttle restriction (56) and the additional throttle restriction (55) are both opened in order to permit the depressurization of the pressure chamber (39) to take place.

5. The fuel injection device according to claim 4, wherein the additional throttle restriction (55) of the actuating valve (31) can be opened or closed by a sliding seal constituted by the valve member (51).

6. The fuel injection device according to claim 1, wherein a 3/3-way valve is used to control the control valve (32) embodied in the form of a servo valve.

7. The fuel injection device according to claim 6, wherein a valve equipped with a magnetic coil apparatus (58, 60), or an actuating valve (31) equipped with a piezoelectric actuator is used as the actuating valve (31) of the control valve (32).

8. The fuel injection device according to claim 1, wherein different switched positions of the multistage actuating valve (31) produce different opening speeds of the servo valve piston (35), thus varying the injection pressure curve (90).

9. The fuel injection device according to claim 8, wherein, with a slower opening speed of the servo valve piston (35), an injection occurs that has a first, slower pressure increase (91) and with a second, faster opening speed of the servo valve piston (35), an injection occurs with a second, faster pressure increase (92).

10. A fuel injector (3) for injecting fuel into the combustion chambers of an internal combustion engine the fuel injector comprising an injection valve member (18) and a pressure booster (5) that has a working chamber (8), which is continuously connected to a common rail (1) and is separated from a differential pressure chamber (9) by a piston part (6, 13), it being possible to either depressurize or pressurize the differential pressure chamber (9) of the pressure booster (5) by means of a valve (30), a valve (30) operable to depressurize or pressurize the differential pressure chamber (9) of the pressure booster (5) and to control the injection valve member (18), the valve (30) having a control valve (32), which is equipped with a servo valve piston (35), and an actuator-triggered multistage actuating valve (31), wherein in an intermediate position of a valve member (51) of the actuating valve (31), when an actuator (60) is supplied with a first current level (71), a throttle restriction (56) functioning as an outlet throttle is opened in order to depressurize the pressure chamber (39) of the control valve (32), wherein the valve member (51) of the actuating valve (31) cooperates with a valve seat (100), to close the additional throttle restriction (55) when the actuator (60) of the actuating valve (31) is supplied with the second, higher current level (72) so that the pressure chamber (39) is depressurized solely via the throttle restriction (56) and the servo valve piston (35) opens slowly.

11. A fuel injector (3) for injecting fuel into the combustion chambers of an internal combustion engine, the fuel injector comprising an injection valve member (18) and a pressure booster (5) that has a working chamber (8), which is continuously connected to a common rail (1) and is separated from a differential pressure chamber (9) by a piston part (6, 13), it being possible to either depressurize or pressurize the differential pressure chamber (9) of the pressure booster (5) by means of a valve (30), a valve (30) operable to depressurize or pressurize the differential pressure chamber (9) of the pressure booster (5) and to control the injection valve member (18), the valve (30) having a control valve (32), which is equipped with a servo valve piston (35), and an actuator-triggered multistage actuating valve (31), wherein in an intermediate position of a valve member (51) of the actuating valve (31), when an actuator (60) is supplied with a first current level (71), a throttle restriction (56) functioning as an outlet throttle is opened in order to depressurize the pressure chamber (39) of the control valve (32), wherein, when the actuator (60) of the actuating valve (31), whose valve member (51) has a valve seat (100), is supplied with current in an intermediate position of the valve member (51), both the throttle restriction (56) and the throttle restriction (55) are open, which results in a rapid depressurization of the pressure chamber (39) of the control valve (32).

* * * * *